US010486940B2

(12) United States Patent
Witczak et al.

(10) Patent No.: US 10,486,940 B2
(45) Date of Patent: Nov. 26, 2019

(54) ALIGNMENT SYSTEM FOR AN ELEVATOR CAR

(71) Applicant: OTIS ELEVATOR COMPANY, Farmington, CT (US)

(72) Inventors: Tadeusz Pawel Witczak, Bethel, CT (US); Bruce P. Swaybill, Farmington, CT (US); Zbigniew Piech, Cheshire, CT (US); Richard J. Ericson, Southington, CT (US); Richard E. Kulak, Bristol, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 414 days.

(21) Appl. No.: 15/244,129

(22) Filed: Aug. 23, 2016

(65) Prior Publication Data

US 2017/0057784 A1 Mar. 2, 2017

Related U.S. Application Data

(60) Provisional application No. 62/209,384, filed on Aug. 25, 2015.

(51) Int. Cl.

| | |
|---|---|
| ***B66B 7/02*** | (2006.01) |
| ***B66B 9/00*** | (2006.01) |
| ***B66B 11/04*** | (2006.01) |

(52) U.S. Cl.

CPC ..... *B66B 7/02* (2013.01); *B66B 9/003* (2013.01); *B66B 11/0407* (2013.01)

(58) Field of Classification Search

CPC ..... B66B 7/02; B66B 9/003; B66B 11/0407

See application file for complete search history.

(56) References Cited

U.S. PATENT DOCUMENTS

| | | | | |
|---|---|---|---|---|
| 134,698 | A * | 1/1873 | Otis | F16C 29/045 187/408 |
| 3,244,258 | A * | 4/1966 | Neidert | B66B 7/02 187/359 |
| 3,658,155 | A * | 4/1972 | Salter | B66B 9/00 187/270 |
| 3,741,351 | A * | 6/1973 | Suozzo | B66B 7/02 187/313 |
| 5,235,144 | A * | 8/1993 | Matsui | B66B 9/003 187/250 |
| 5,773,772 | A * | 6/1998 | McCarthy | B61B 15/00 187/249 |

(Continued)

FOREIGN PATENT DOCUMENTS

| | | |
|---|---|---|
| EP | 0885831 A2 | 12/1998 |
| GB | 2319239 A | 5/1998 |

(Continued)

*Primary Examiner* — Michael A Riegelman

(74) *Attorney, Agent, or Firm* — Cantor Colburn LLP

(57) ABSTRACT

An elevator system includes a lane and at least one rail extending along the lane. The at least one rail includes a first end portion and a second end portion. A transfer station is arranged at one of the first end portion and the second end portion, and an alignment system is arranged at the transfer station. The alignment system includes at least one guide member configured and disposed to establish a desired alignment between an elevator car and the at least one rail.

8 Claims, 5 Drawing Sheets

(56) References Cited

U.S. PATENT DOCUMENTS

| | | | | |
|---|---|---|---|---|
| 5,799,755 | A * | 9/1998 | Wan | B66B 9/00 187/249 |
| 5,816,368 | A * | 10/1998 | Barrett | B66B 7/022 187/289 |
| 5,984,053 | A * | 11/1999 | Lee | B66B 7/046 182/141 |
| 6,955,245 | B2 * | 10/2005 | Dunser | B66B 1/2466 187/249 |
| 7,537,089 | B2 * | 5/2009 | Duenser | B66B 1/2466 187/247 |
| 7,871,231 | B2 * | 1/2011 | Oshima | B65G 47/54 198/349.1 |
| 9,016,438 | B2 * | 4/2015 | Altenburger | B66B 9/003 187/240 |
| 2014/0190774 | A1 * | 7/2014 | Hsu | B66B 9/003 187/406 |
| 2017/0057784 | A1 * | 3/2017 | Witczak | B66B 7/02 |
| 2017/0057786 | A1 * | 3/2017 | Witczak | B66B 7/046 |
| 2017/0158461 | A1 * | 6/2017 | Roberts | B66B 1/30 |
| 2018/0009633 | A1 * | 1/2018 | Fargo | B66B 19/002 |
| 2018/0009636 | A1 * | 1/2018 | Jedryczka | B66B 9/003 |
| 2018/0029829 | A1 * | 2/2018 | Piech | B66B 7/04 |
| 2018/0170714 | A1 * | 6/2018 | Witczak | B66B 1/2491 |
| 2018/0194594 | A1 * | 7/2018 | Kato | B66B 7/02 |
| 2018/0222722 | A1 * | 8/2018 | Witczak | B66B 9/003 |
| 2018/0237269 | A1 * | 8/2018 | Witczak | B66B 19/00 |
| 2018/0244495 | A1 * | 8/2018 | Swaybill | B66B 1/3492 |

FOREIGN PATENT DOCUMENTS

| | | | |
|---|---|---|---|
| WO | 2005115906 | A2 | 12/2005 |
| WO | 2014158127 | A1 | 10/2014 |

* cited by examiner

ALIGNMENT SYSTEM FOR AN ELEVATOR CAR

CROSS-REFERENCE TO RELATED APPLICATIONS

This application claims the benefit of U.S. provisional patent application Ser. No. 62/209,384, filed Aug. 25, 2015, the entire contents of which are incorporated herein by reference.

BACKGROUND

Exemplary embodiments pertain to the art of elevator systems and, more particularly to an alignment system for introducing elevator cars into a lane.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single lane. There exist ropeless elevator systems in which a first lane is designated for upward traveling elevator cars and a second lane is designated for downward traveling elevator cars with at least two transfer stations in the hoistway used to move elevator cars horizontally between the first lane and second lane.

Transfer stations also provide an opportunity to remove an elevator car from a lane for repair and/or service. Once removed from the lane, the elevator car may be taken to a work space and/or simply placed in a holding area, e.g., parked until needed. The elevator car may later be brought back into service. At such a time, the elevator car is moved back to an elevator lane and connected to rails. During installation, it is desirable to align the elevator car with the rails. Improper alignment could result in reduced operating efficiency and increased wear on various drive components of the elevator car.

BRIEF DESCRIPTION

Disclosed is an elevator system including a lane and at least one rail extending along the lane. The at least one rail includes a first end portion and a second end portion. A transfer station is arranged at one of the first end portion and the second end portion, and an alignment system is arranged at the transfer station. The alignment system includes at least one guide member configured and disposed to establish a desired alignment between an elevator car and the at least one rail.

In addition to one or more of the features described above or below, or as an alternative, further embodiments could include an elevator car arranged at the transfer station, the elevator car including at least one roller configured and disposed to traverse the at least one guide member and engage the at least one rail.

In addition to one or more of the features described above or below, or as an alternative, further embodiments could include wherein the at least one rail includes a first surface, an opposing, second surface, and a third surface extending between the first and second surfaces, the at least one roller including a first roller and a second roller, the first roller being configured and disposed to engage the first surface and the second roller being configured and disposed to engage the third surface.

In addition to one or more of the features described above or below, or as an alternative, further embodiments could include wherein the at least one guide member includes a first guide member and a second guide member, the first guide member being configured and disposed to guide the first roller onto the first surface and the second guide member being configured and disposed to guide the second roller onto the third surface.

In addition to one or more of the features described above or below, or as an alternative, further embodiments could include wherein the at least one guide member includes a tapered surface.

In addition to one or more of the features described above or below, or as an alternative, further embodiments could include wherein the tapered surface is curvilinear.

In addition to one or more of the features described above or below, or as an alternative, further embodiments could include wherein the at least one guide member is arranged at the one of the first and second end portions of the at least one rail.

In addition to one or more of the features described above or below, or as an alternative, further embodiments could include wherein the at least one guide member is mounted to the lane at the one of the first and second end portions.

In addition to one or more of the features described above or below, or as an alternative, further embodiments could include wherein the elevator car includes a linear motor moveable portion and the lane includes a linear motor fixed portion, the alignment system further establishing a desired alignment of the moveable portion and the fixed portion of the linear motor.

Also disclosed is a method of aligning an elevator car with at least one rail in a transfer station. The method includes positioning the elevator car in the transfer station associated with a lane, locating at least one guide element on the elevator car adjacent to at least one guide member provided at one of a first and second end portions of the at least one rail, and shifting the elevator car into the lane causing the at least one guide element to traverse along the at least one guide member to align the elevator car with the at least one rail.

In addition to one or more of the features described above or below, or as an alternative, further embodiments could include wherein locating the at least one guide element includes positioning at least one roller mounted on the elevator car at the at least one guide member.

In addition to one or more of the features described above or below, or as an alternative, further embodiments could include wherein positioning the at least one roller includes positioning a first roller configured to rotate about a first axis at a first guide element, and a second roller configured to rotate about a second axis, substantially orthogonal relative to the first axis at a second guide element.

In addition to one or more of the features described above or below, or as an alternative, further embodiments could include wherein shifting the elevator car includes guiding the first roller onto a first surface of the at least one rail along the first guide member and guiding the second roller onto a second surface of the at least one rail along the second guide member.

In addition to one or more of the features described above or below, or as an alternative, further embodiments could include guiding a third roller configured and disposed to rotate about a third axis that is substantially parallel to the first axis onto a third surface of the at least one rail.

In addition to one or more of the features described above or below, or as an alternative, further embodiments could include wherein shifting the elevator car includes transitioning the at least one guide element along a tapered surface of the at least one guide member.

In addition to one or more of the features described above or below, or as an alternative, further embodiments could include wherein transitioning the at least one guide element along the tapered surface includes transitioning the at least one guide element along a curvilinear surface.

In addition to one or more of the features described above or below, or as an alternative, further embodiments could include wherein shifting the elevator car into the lane further includes aligning drive components that provide motivational power to shift the elevator car along the lane.

In addition to one or more of the features described above or below, or as an alternative, further embodiments could include wherein aligning drive components includes aligning a motor primary of a linear motor with a motor secondary of a linear motor.

In addition to one or more of the features described above or below, or as an alternative, further embodiments could include wherein aligning the motor primary with the motor secondary includes positioning the motor primary extending from the lane adjacent at least one motor secondary provided on the car.

In addition to one or more of the features described above or below, or as an alternative, further embodiments could include wherein positioning the motor primary includes locating the motor primary between a first motor secondary portion and a second motor secondary portion of the at least one motor secondary.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
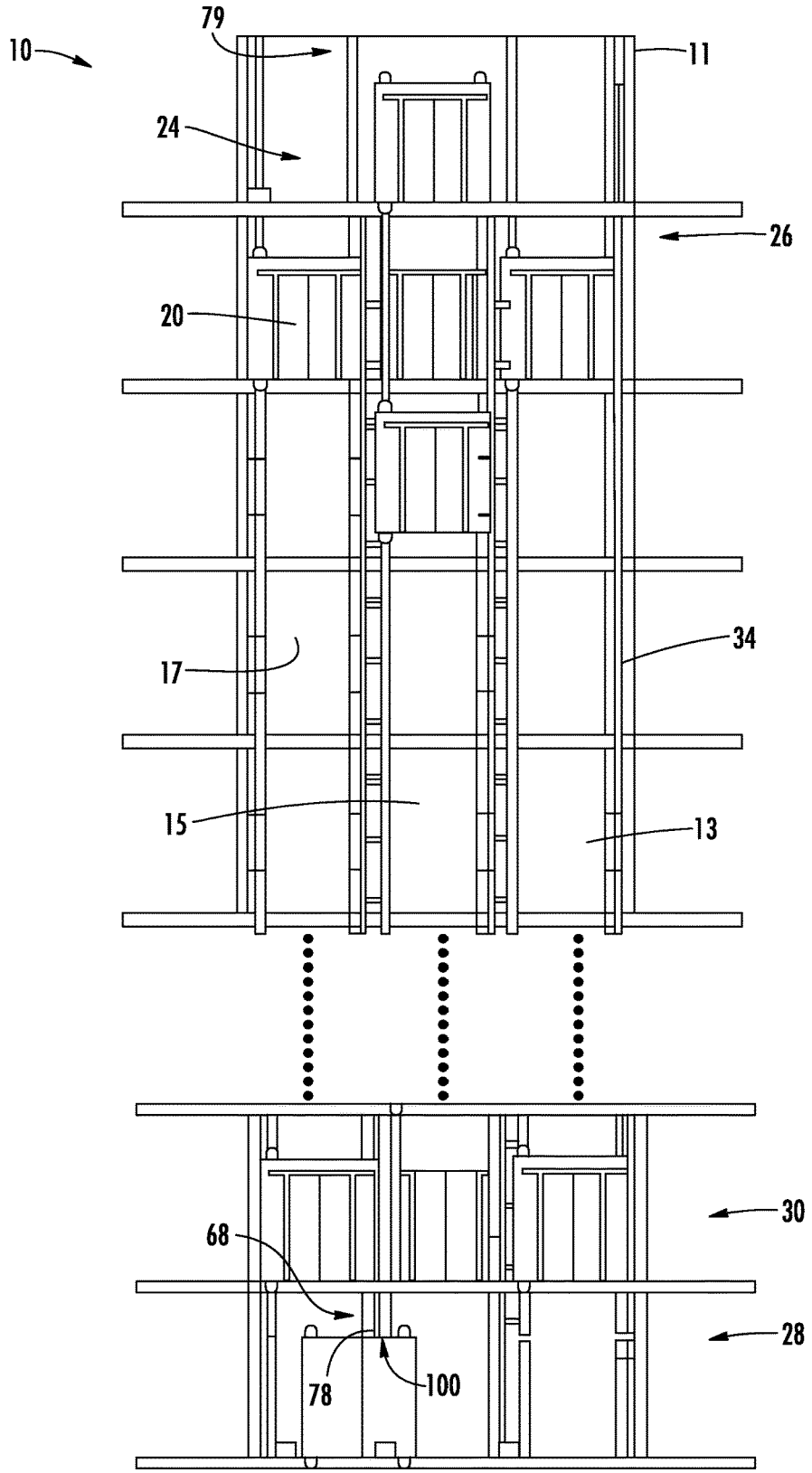
FIG. 1 illustrates a multicar ropeless (MCRL) elevator system having an elevator car alignment system, in accordance with an aspect of an exemplary embodiment.
Figure 2:
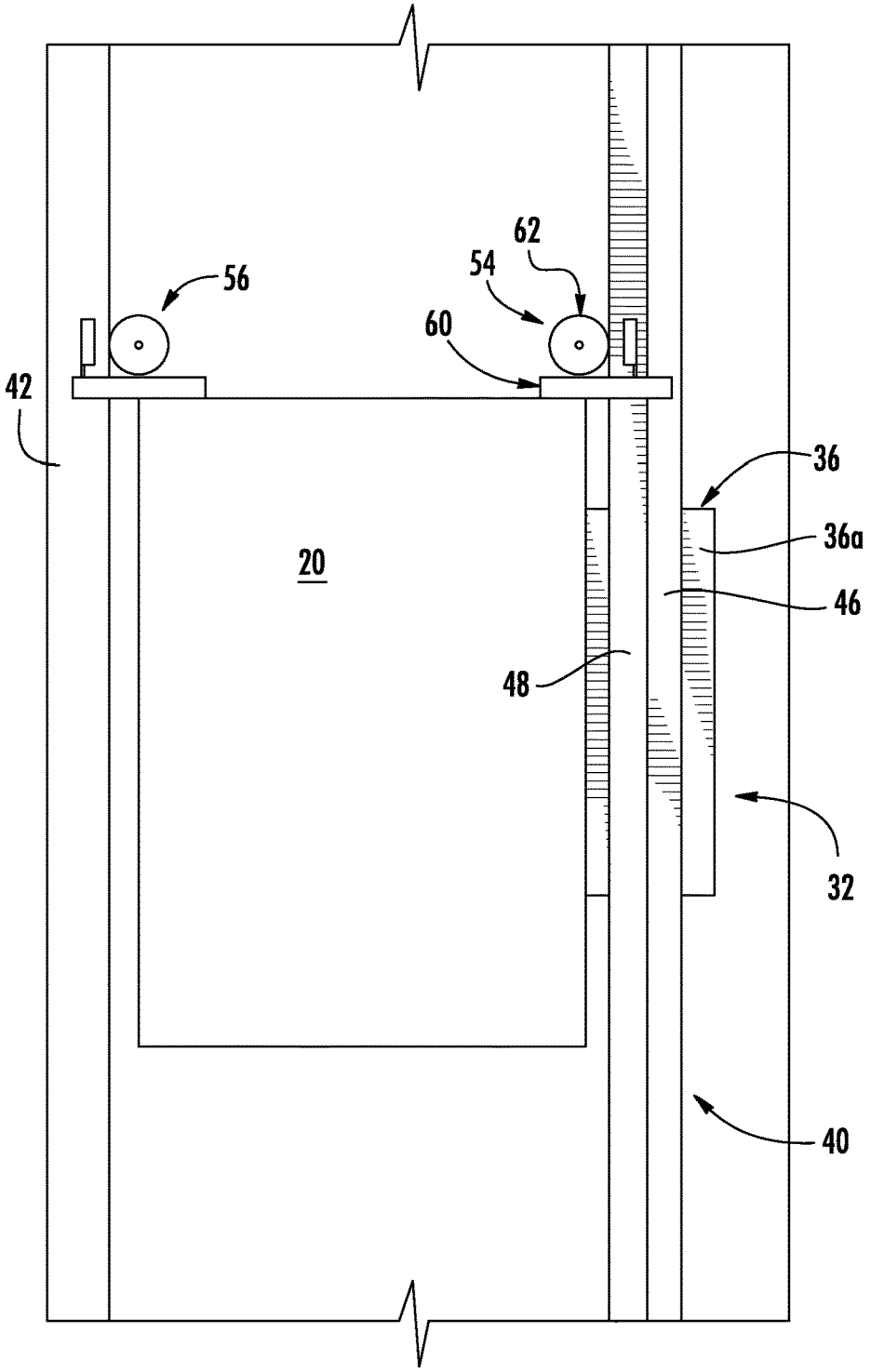
FIG. 2 is a schematic illustration of one elevator car of the MCRL elevator system of FIG. 1, in accordance with an aspect of an exemplary embodiment.

Referring to FIGS. 1 and 2, a multicar, ropeless (MCRL) elevator system 10 is illustrated according to one embodiment. Elevator system 10 includes a hoistway 11 having a plurality of lanes 13, 15 and 17. While three lanes are shown in FIG. 1, it is understood that embodiments may be used with multicar, ropeless elevator systems that have any number of lanes. In each lane 13, 15 and 17, elevator cars 20 travel in one direction, i.e., up or down, or in multiple directions (i.e., both up and down). For example, in FIG. 1 elevator cars 20 in lanes 13 and 17 travel up and elevator cars 20 in lane 15 travel down. One or more elevator cars 20 may travel in a single lane 13, 15 and 17.

In the exemplary embodiment shown, an upper transfer station 24 may be located above a top most floor 26. Upper transfer station 24 facilitates horizontal travel of one or more elevator cars 20 between select ones of lanes 13, 15 and 17. It is understood that upper transfer station 24 may be located at top most floor 26. A lower transfer station 28 may be arranged below a first floor 30. In a manner similar to that described above, lower transfer station 28 facilitates horizontal travel of one or more of elevator cars 20 between select ones of lanes 13, 15 and 17. It is understood that lower transfer station 28 may be located at first floor 30. Although not shown in FIG. 1, one or more intermediate transfer stations may be used between lower transfer station 28 and upper transfer station 24. Intermediate transfer stations may be similar to lower transfer station 28 and/or upper transfer station 24. Additionally, both lower transfer station 28 and upper transfer station 24 may be at system terminals, or at any floor above or below. Therefore, it is to be understood that upper transfer station 24 represents an upper most transfer station in MCRL elevator system 10, and lower transfer station 28 represents a lower most transfer station in MCRL elevator system 10.

Transfer stations at various locations advantageously impact the functional capability of the system by increasing loop options. For example, the lanes 13, 15 and 17 may include elevator cars 20 traveling in a uni-directional or bi-directional manner. Furthermore, parking of elevator cars 20 may be performed in transfer stations 24 and 28 depending on the particular location and configuration. Therefore, the term "transfer station" should be understood to include a location in which elevator cars 20 may be shifted between lanes 13, 15 and 17 and/or a location in which elevator cars may be transferred out of service and parked. An elevator car may be "parked" during times of off-peak usage, for routine maintenance, and/or repair.

Figure 3:
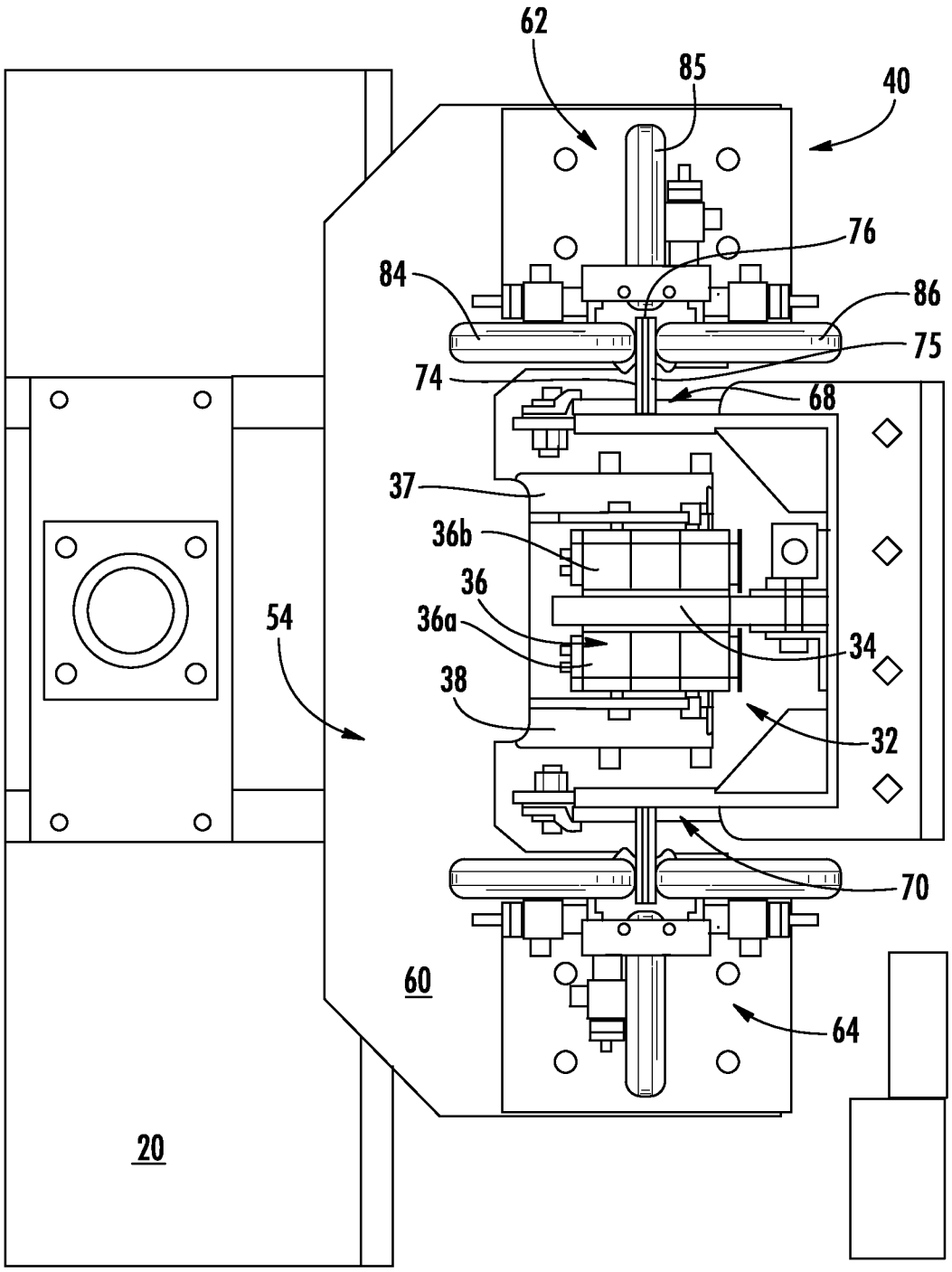
FIG. 3 depicts a bottom view of the elevator car and elevator car alignment system, in accordance with an exemplary embodiment.

Elevator cars 20 are self-propelled using, for example, a linear motor system 32 having multiple drive components, such as one or more fixed portions or motor primaries 34 and one or more moving portions or motor secondaries 36. The one or more fixed portions 34 are mounted in, and extend along, lanes 13, 15 and 17. The one or more moving portions 36 include first and second secondary portions **36*a* and 36*b* mounted on first and second support rails 37 and 38 extending from elevator cars 20 (FIG. 3). In accordance with an aspect of an exemplary embodiment, moving portion(s) 36 is/are positioned and arranged to disengage from fixed portion(s) 34 allowing elevator car 20 to freely translate or horizontally shift into, for example, one or the other of upper transfer station 24 and lower transfer station 28 as well as any transfer stations that may be arranged therebetween. Drive signals are provided to fixed portion 34 and/or moving portion 36 from a controller (not shown) to control movement of elevator cars 20 in a respective one of lanes 13, 15 and/or 17**.

As shown in FIG. 2, elevator car 20 is guided by one or more guide structures or rails 40 extending along the length of lane 15. Guide structure 40 may be affixed to a hoistway wall (not separately labeled), a propulsion device (also not separately labeled), a carriage structural member 42, or stacked over each other. For ease of illustration, the view of FIG. 2 only depicts a single side guide structure 40; however, there may be two or more guide structures 40 positioned, for example, on opposite sides of elevator car 20. Guide structure 40 may include a first guide rail assembly 46 and a second guide rail assembly 48.

In accordance with an aspect of an exemplary embodiment, elevator car 20 may include a first roller system 54 that operatively engages with first rail assembly 46 and a second roller system 56 that operatively engages with second rail assembly 48. As each roller system 54, 56 and each rail assembly 46, 48 may be similarly formed, a detailed description will follow with reference to first roller system 54 and first rail assembly 46 with an understanding that second roller system 56 and second rail assembly 48 may be similarly constructed. As will be detailed more fully below, first roller system 54 is supported from elevator car 20 by a frame 60 and includes a first roller assembly 62 and a second roller assembly 64.

First guide rail assembly 46 includes a first rail 68 and a second rail 70. As each rail 68, 70 may be similarly formed, a detailed description will follow with respect to first rail 68 with an understanding that second rail 70 may include similar structure. First rail 68 includes a first surface 74, a second, opposing surface 75, and a third surface 76. Third surface 76 extends substantially perpendicularly relative to first and second surfaces 74 and 75. First rail 68 includes a first end portion 78 arranged in lower transfer station 28 and a second end portion 79 arranged at upper transfer station 24.

First roller assembly 62 is operatively associated with first rail 68 and second roller assembly 64 is operatively associated with second rail 70. As each roller assembly 62, 64 may be similarly formed, a detailed description will follow with reference to first roller assembly 62 with an understanding that second roller assembly 64 may include similar structure. First roller assembly 62 includes a first guide element or roller 84, a second guide element or roller 85, and a third guide element or roller 86. First roller 84 is mounted to a first axle (not separately labeled) and rotates about a first axis, second roller 85 is mounted to a second axle (also not separately labeled) and rotates about a second axis that is substantially perpendicular to the first axis, and third roller 86 is mounted to a third axle (also not separately labeled) and rotates about a third axis that is substantially coincident with the first axis. As will be detailed more fully below, first roller 84 rides along first surface 74 of first rail 68, second roller 85 rides along third surface 76, and third roller 86 rides along second surface 75.

Figure 4:
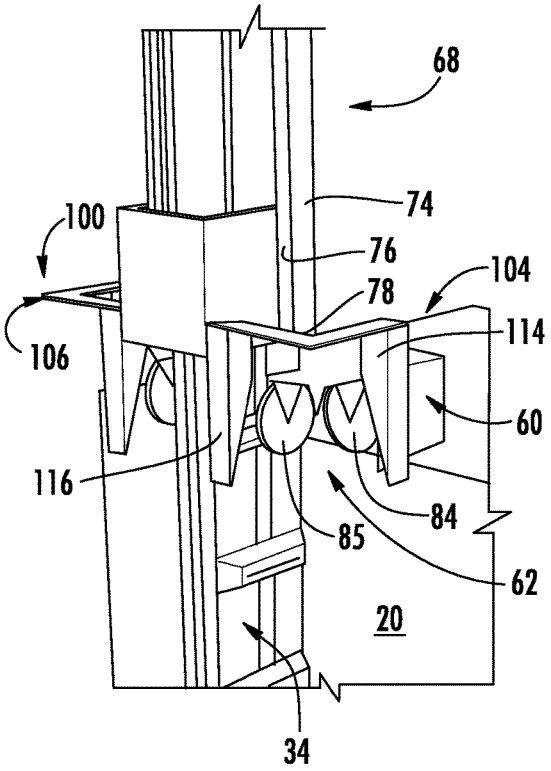
FIG. 4 depicts the elevator car of FIG. 3 engaging with the elevator car alignment system in a transfer station, in accordance with an aspect of an exemplary embodiment.
Figure 5:
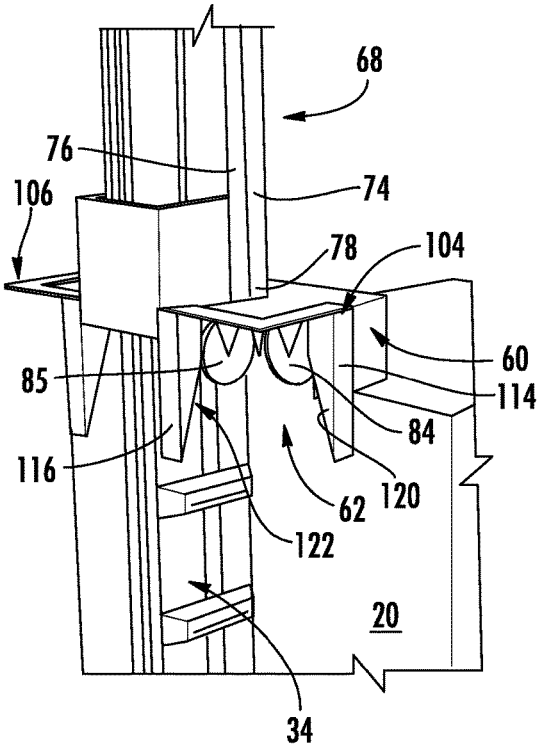
FIG. 5 depicts the elevator car of FIG. 4 transitioning along the elevator car alignment system, in accordance with an aspect of an exemplary embodiment.
Figure 6:
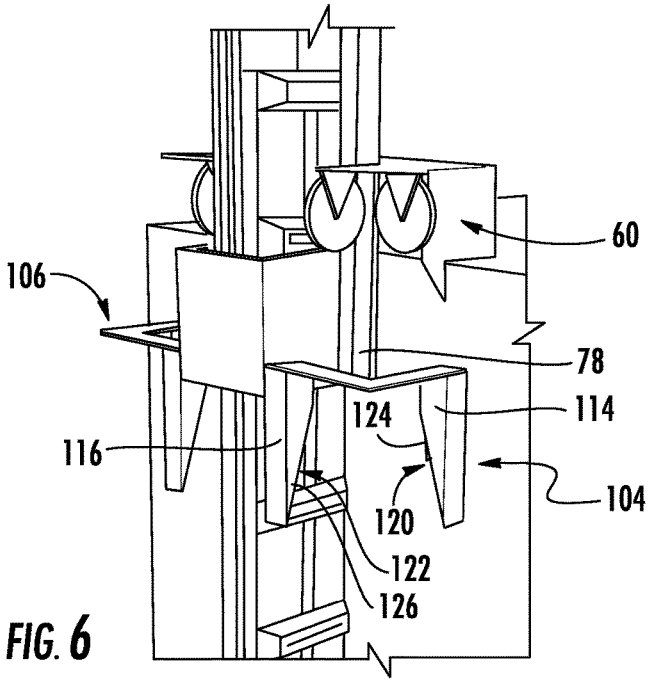
FIG. 6 depicts the elevator car of FIG. 5 transitioning from the elevator car alignment system onto a rail of the MCRL elevator system of FIG. 1.

In accordance with an exemplary embodiment, MCRL elevator system 10 includes an alignment system 100 that establishes a desired alignment between elevator car 20 and first and second guide rail assemblies 46 and 48 as well as fixed portions 34 and moving portions 36 of linear motor system 32. As shown in FIGS. 4-6, alignment system 100 includes a first guide system 104 and a second guide system 106 arranged in lower transfer station 28. First and second guide systems 104 and 106 are arranged to direct first and second roller assemblies 62 and 64 onto respective ones of first and second rails 68 and 70. At this point, it should be understood, that an additional guide system (not shown) may be arranged to align second roller system 56 with second guide rail assembly 48. Further, as each guide system 104, 106 may be similarly formed, a detailed description will follow with reference to first guide system 104 with an understanding that second guide system 106 may include similar structure.

In accordance with an aspect of an exemplary embodiment, first guide system 104 is arranged at first end portion 78 of first rail 68 and includes a first guide member 114 and a second guide member 116. First guide member 114 is arranged to direct or lead first roller 84 onto first surface 74 of first rail 68. Second guide member 116 is arranged to direct or lead second roller 85 onto third surface 76. Third roller 86 will be led onto second surface 75 by virtue of a spaced relationship relative to first roller 84. As elevator car 20 travels upward, and first, second, and third rollers 84-86 move along first rail 68, motor secondaries **36*a* and 36*b* are brought into alignment with motor primary 34 of linear motor system 32. More specifically, motor primary 34 is guided between first and second opposing motor secondaries 36*a* and 36*b* provided on elevator car 20. Once in position, linear motor system 32 may motivate elevator car 20 along one of lanes 13, 15 and 17**.

Figure 7:
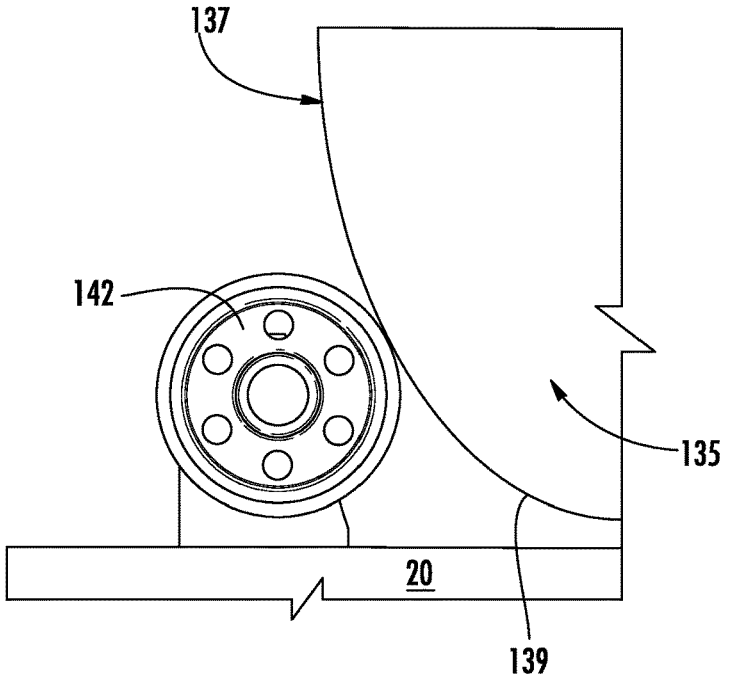
FIG. 7 depicts an elevator car engaging with a guide member of the elevator car alignment system, in accordance with another aspect of an exemplary embodiment.
Figure 8:
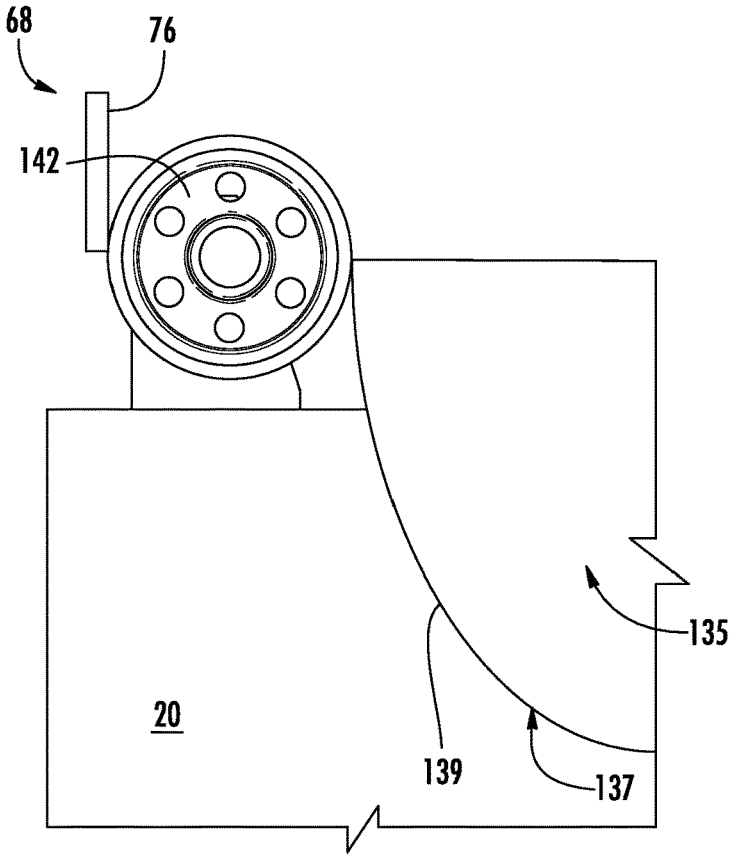
FIG. 8 depicts the elevator car of FIG. 7 transitioning from the guide member onto a rail of the MCRL elevator system, in accordance with another aspect of an exemplary embodiment.

In further accordance with an exemplary aspect, first guide member 114 includes a first tapered surface 120 and second guide member 116 includes a second tapered surface 122. First and second tapered surfaces 120 and 122 include substantially linear profiles, such as shown at 124 and 126, that guide or lead first and second rollers 84 and 85 onto first and third surfaces 74 and 76 of first rail 68. At this point it should be understood that guide members may be formed having various guide surfaces. As shown in FIGS. 7 and 8, a guide member 135 may include a tapered surface 137 having a curvilinear profile 139. Curvilinear profile 139 guides a roller 142 mounted to elevator car 20 into alignment with, for example, first rail 68.

At this point it should be understood that the exemplary embodiments describe a system for aligning an elevator car with one or more rails. The alignment system includes guide members that locate guide elements on an elevator car into a desired orientation and position to ride along a rail extending along a lane. Further, it should be understood that while shown in connection with a lower transfer station, the exemplary embodiments are equally applicable to an upper transfer station as well as intermediate transfer stations.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:

a lane;

an elevator car configured to travel in the lane in a vertical direction between floors;

at least one rail extending along the lane, the at least one rail including a first end portion and a second end portion;

a transfer station arranged at one of the first end portion and the second end portion; and an alignment system arranged at the transfer station, the alignment system including at least one guide member configured and disposed to establish a desired alignment between the elevator car and the at least one rail;

the elevator car arranged at the transfer station, the elevator car including at least one roller configured and disposed to traverse the at least one guide member and engage the at least one rail;

wherein the at least one rail includes a first surface, an opposing, second surface, and a third surface extending between the first and second surfaces, the at least one roller including a first roller and a second roller, the first roller being configured and disposed to engage the first surface and the second roller being configured and disposed to engage the third surface.

2. The elevator system according to claim 1, wherein the at least one guide member includes a first guide member and a second guide member, the first guide member being configured and disposed to guide the first roller onto the first surface and the second guide member being configured and disposed to guide the second roller onto the third surface.

3. The elevator system according to claim 1, wherein the at least one guide member includes a tapered surface.

4. The elevator system according to claim 3, wherein the tapered surface is curvilinear.

5. The elevator system according to claim 1, wherein the at least one guide member is arranged at the one of the first and second end portions of the at least one rail.

6. The elevator system according to claim 5, wherein the at least one guide member is mounted to the lane at the one of the first and second end portions.

7. The elevator system according to claim 1, wherein the elevator car includes a linear motor moveable portion and the lane includes a linear motor fixed portion, the alignment system further establishing a desired alignment of the moveable portion and the fixed portion of the linear motor.

8. An elevator system comprising:

a lane;

an elevator car configured to travel in the lane in a vertical direction between floors;

at least one rail extending along the lane, the at least one rail including a first end portion at a first floor and a second end portion at a second floor above the first floor, the at least one rail extending along the vertical direction in the lane;

a transfer station arranged at one of the first end portion and the second end portion; and an alignment system arranged at the transfer station, the alignment system including at least one guide member configured and disposed to establish a desired alignment between the elevator car and the at least one rail;

the elevator car including at least one roller configured to contact the at least one guide member, travel along a tapered surface of the at least one guide member and engage the at least one rail upon traversing the at least one guide member.

* * * * *